US012565359B2

(12) United States Patent
Rosenberg

(10) Patent No.: US 12,565,359 B2
(45) Date of Patent: Mar. 3, 2026

(54) SEALING LID

(71) Applicant: Jonah Ari Rosenberg, Cincinnati, OH (US)

(72) Inventor: Jonah Ari Rosenberg, Cincinnati, OH (US)

( * ) Notice: Subject to any disclaimer, the term of this patent is extended or adjusted under 35 U.S.C. 154(b) by 11 days.

(21) Appl. No.: 18/438,889

(22) Filed: Feb. 12, 2024

(65) Prior Publication Data

US 2024/0270449 A1 Aug. 15, 2024

Related U.S. Application Data

(60) Provisional application No. 63/484,573, filed on Feb. 13, 2023.

(51) Int. Cl.
*B65D 43/02* (2006.01)

(52) U.S. Cl.
CPC ..... *B65D 43/0212* (2013.01); *B65D 2543/00074* (2013.01); *B65D 2543/00351* (2013.01); *B65D 2543/00509* (2013.01)

(58) Field of Classification Search
CPC ..... B65D 51/145; B65D 2543/00351; B65D 41/125; B65D 2543/00074; B65D 43/0212
USPC ..... 220/780; 215/352, 349
See application file for complete search history.

(56) References Cited

U.S. PATENT DOCUMENTS

| | | | | |
|---|---|---|---|---|
| 814,531 | A * | 3/1906 | Gillette | B65D 41/12 215/324 |
| 4,458,469 | A * | 7/1984 | Dunn | B65D 7/42 220/624 |
| 2010/0176134 | A1* | 7/2010 | Cramer | B65D 51/145 220/378 |

* cited by examiner

*Primary Examiner* — Jeffrey R Allen
(74) *Attorney, Agent, or Firm* — Shumaker, Loop & Kendrick, LLP; James D. Miller

(57) ABSTRACT

A lid element for use with a container having a rim includes a centrally disposed axially projecting portion, an annular peripheral portion disposed radially outwardly of the axially projecting portion, and an annular sealing element disposed on the peripheral portion and configured to engage the rim of the container. When the sealing element engages the rim of the container, the axially projecting portion projects axially from the peripheral portion beyond the rim of the container with respect to an interior axial direction of the lid element to aid in displacing a food item stored as or in a liquid within the interior of the container.

16 Claims, 3 Drawing Sheets

SEALING LID

CROSS-REFERENCE TO RELATED APPLICATION

This patent application claims priority to U.S. Provisional Patent Application Ser. No. 63/484,573, filed on Feb. 13, 2023, the entire disclosure of which is hereby incorporated herein by reference.

FIELD OF THE INVENTION

The invention relates to a lid element of a two-part container closure assembly such as is traditionally used with canning containers, and more particularly, to a lid element having an axially projecting portion configured to extend into an interior of the container for displacing a volume of liquid contents thereof.

BACKGROUND OF THE INVENTION

Canning containers or other containers in need of sealing often utilize a two-part container closure including a lid element and a retainer element. The lid element typically includes an elastomeric ring about an underside thereof that is used to form the seal with a rim of a corresponding container. The retaining element may be a threaded collar that is mated with corresponding threads adjacent the rim of the container to position the peripheral portions of the lid element between the retaining element and the rim.

Traditionally, such lid elements are engaged to the rim of the container in a manner wherein the lid element is arranged substantially in parallel to the plane of the rim such that a cylindrical space is formed between an upper surface of whatever food item is stored within the container and an underside of the lid element. Because air fills this cylindrical space, oxygen is readily provided to any disposed bacteria within the interior of the container, and this oxygen is utilized by the bacteria in performing a decomposition process with respect to the corresponding food item.

Accordingly, it would be desirable to create a lid element that reduces the availability of such oxygen within the interior of the container in order to improve the shelf life of food items stored within such containers.

SUMMARY OF THE INVENTION

Consistent and consonant with the present invention, an improved lid element for use in canning applications has been surprisingly discovered.

In one embodiment of the invention, a lid element for use with a container having a rim includes a centrally disposed axially projecting portion, an annular peripheral portion disposed radially outwardly of the axially projecting portion, and an annular sealing element disposed on the peripheral portion and configured to engage the rim of the container. When the sealing element engages the rim of the container, the axially projecting portion projects axially from the peripheral portion beyond the rim of the container with respect to an interior axial direction of the lid element.

According to another embodiment of the present invention, a food storage system includes a container, a lid element, and a retainer element. The container has a rim adjacent a threaded portion thereof with an interior of the container including a food item stored as or within a liquid. The lid element includes a centrally disposed axially projecting portion, an annular peripheral portion disposed radially outwardly of the axially projecting portion, and an annular sealing element disposed on the peripheral portion and engaging the rim of the container. The axially projecting portion projects axially from the peripheral portion beyond the rim of the container with respect to an interior axial direction of the lid element to cause a central region of the axially projecting portion to be disposed within the food item. The retainer element is configured to threadably engage the threaded portion of the container with the peripheral portion of the lid element disposed between the retainer element and the rim of the container.

BRIEF DESCRIPTION OF THE DRAWINGS

The above, as well as other objects and advantages of the invention, will become readily apparent to those skilled in the art from reading the following detailed description of a preferred embodiment of the invention when considered in the light of the accompanying drawings.

DETAILED DESCRIPTION OF THE INVENTION

Figure 1:
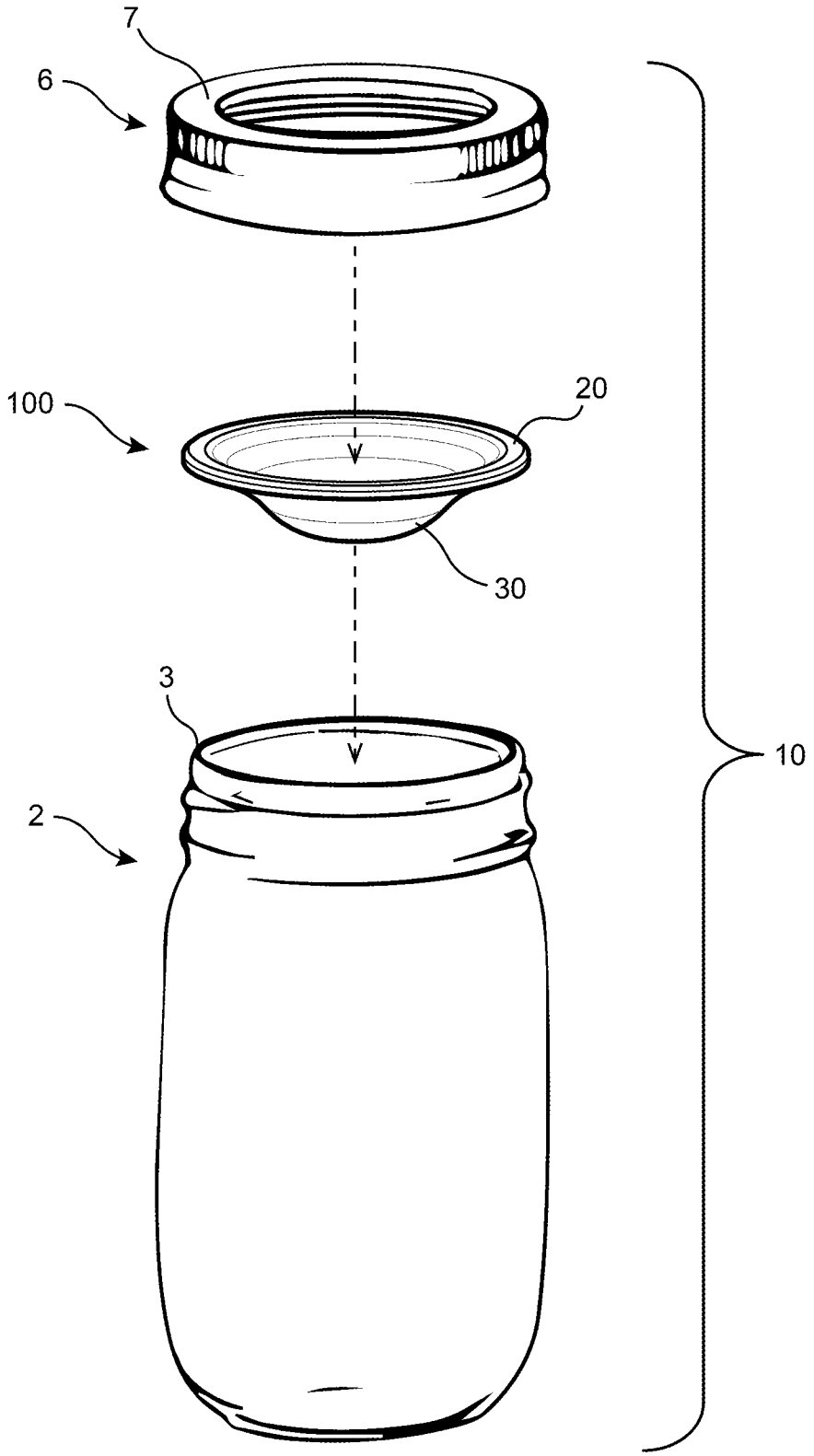
FIG. 1 is an exploded elevational view of a storage system including a container, a lid element, and a retainer ring according to an embodiment of the present invention.

The following description of technology is merely exemplary in nature of the subject matter, manufacture and use of one or more inventions, and is not intended to limit the scope, application, or uses of any specific invention claimed in this application or in such other applications as may be filed claiming priority to this application, or patents issuing therefrom. Regarding methods disclosed, the order of the steps presented is exemplary in nature, and thus, the order of the steps can be different in various embodiments. "A" and "an" as used herein indicate "at least one" of the item is present; a plurality of such items may be present, when possible. Except where otherwise expressly indicated, all numerical quantities in this description are to be understood as modified by the word "about" and all geometric and spatial descriptors are to be understood as modified by the word "substantially" in describing the broadest scope of the technology. "About" when applied to numerical values indicates that the calculation or the measurement allows some slight imprecision in the value (with some approach to exactness in the value; approximately or reasonably close to the value; nearly). If, for some reason, the imprecision provided by "about" and/or "substantially" is not otherwise understood in the art with this ordinary meaning, then "about" and/or "substantially" as used herein indicates at least variations that may arise from ordinary methods of measuring or using such parameters.

All documents, including patents, patent applications, and scientific literature cited in this detailed description are incorporated herein by reference, unless otherwise expressly indicated. Where any conflict or ambiguity may exist between a document incorporated by reference and this detailed description, the present detailed description controls.

Although the open-ended term "comprising," as a synonym of non-restrictive terms such as including, containing, or having, is used herein to describe and claim embodiments of the present technology, embodiments may alternatively be described using more limiting terms such as "consisting of" or "consisting essentially of." Thus, for any given embodiment reciting materials, components, or process steps, the present technology also specifically includes embodiments consisting of, or consisting essentially of, such materials, components, or process steps excluding additional materials, components or processes (for consisting of) and excluding additional materials, components or processes affecting the significant properties of the embodiment (for consisting essentially of), even though such additional materials, components or processes are not explicitly recited in this application. For example, recitation of a composition or process reciting elements A, B and C specifically envisions embodiments consisting of, and consisting essentially of, A, B and C, excluding an element D that may be recited in the art, even though element D is not explicitly described as being excluded herein.

As referred to herein, disclosures of ranges are, unless specified otherwise, inclusive of endpoints and include all distinct values and further divided ranges within the entire range. Thus, for example, a range of "from A to B" or "from about A to about B" is inclusive of A and of B. Disclosure of values and ranges of values for specific parameters (such as amounts, weight percentages, etc.) are not exclusive of other values and ranges of values useful herein. It is envisioned that two or more specific exemplified values for a given parameter may define endpoints for a range of values that may be claimed for the parameter. For example, if Parameter X is exemplified herein to have value A and also exemplified to have value Z, it is envisioned that Parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if Parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, 3-9, and so on. All values provided for the dimensions of certain features of the invention should also be understood to be subject to typical manufacturing inconsistencies and therefore may be associated with corresponding manufacturing tolerances, hence the resulting features of a manufactured article of the invention may include dimensions that vary from those listed herein in accordance with such manufacturing tolerances while remaining within the scope of the present invention.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 2:
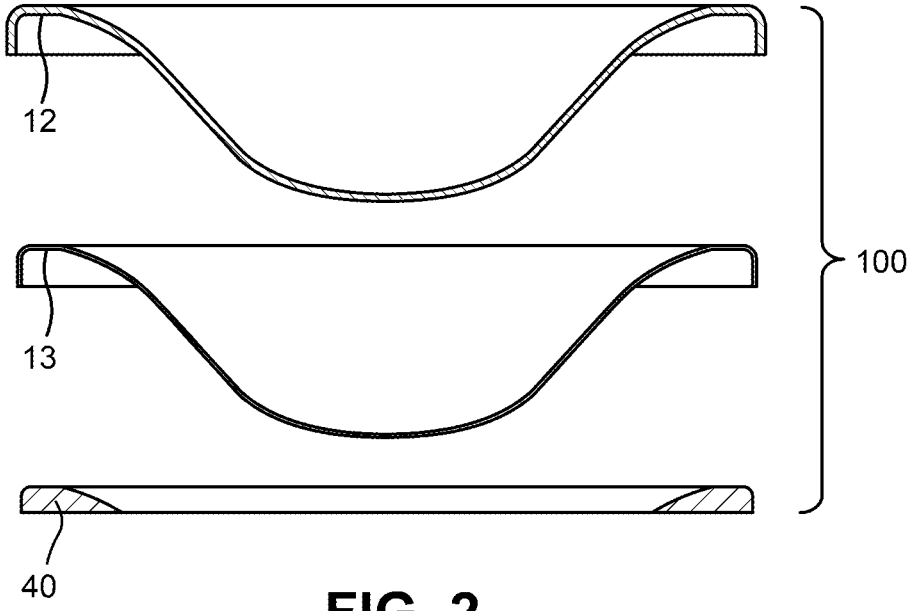
FIG. 2 is an exploded elevational cross-sectional view showing the different layers forming the lid element of FIG. 1.
Figure 3:
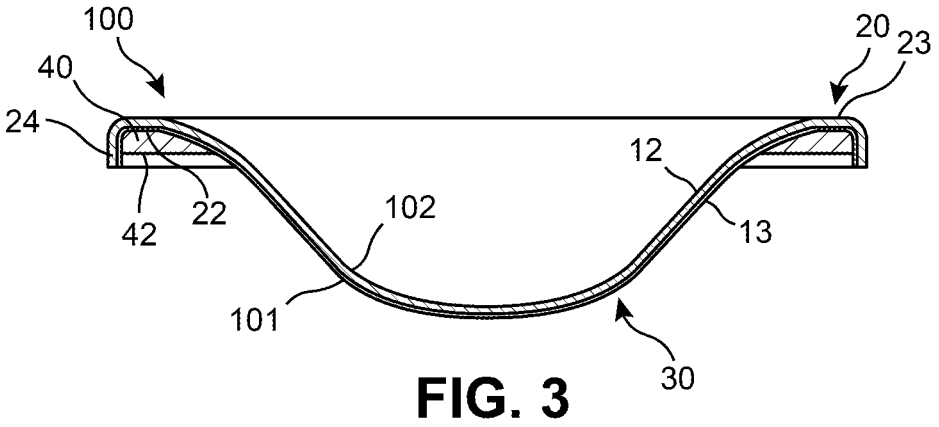
FIG. 3 is an elevational cross-sectional view showing the layers of FIG. 2 in an assembled configuration.

FIGS. 1-3 illustrate a lid element 100 for a storage system 10 according to an embodiment of the present invention. As shown in FIG. 1, the lid element 100 may form a component of a two-part container closure assembly in conjunction with a retainer element 6, wherein the two-part container closure assembly is configured for use with a canning container 2. The lid element 100 is configured to be disposed between a rim 3 of the container 2 and a radially extending flanged portion 7 of the retainer element 6 when the retainer element 6 is threadably engaging the container 2, as explained in greater detail hereinafter. In one embodiment of the invention, the container 2 is formed from glass. However, it is understood other materials can be used as desired which exhibit favorable storage qualities. It should be apparent to one skilled in the art that the lid element 100 of the present invention may be utilized in conjunction with a variety of different containers 2 having a cylindrically shaped rim 3 without departing from the scope of the present invention.

The lid element 100 includes a circular perimeter shape and an axially symmetric configuration relative to a central axis thereof such that a configuration of the lid element 100 is consistent about an entirety of the perimeter of the rim 3 of the corresponding container 2 when the lid element 100 is engaged thereto. The lid element 100 may be formed to include multiple different layers, each of which includes a thickness that is far exceeded by a radial dimension of the lid element 100 to result in each of the layers having a thin-walled plate or disc structure. The lid element 100 is illustrated in FIG. 2 as including two different layers (shown in exploded form), although it should be apparent to one skilled in the art that fewer or greater layers may be utilized while still appreciating the structural benefits of the disclosed lid element 100 as described herein.

The number of layers and the composition of each of the corresponding layers may be selected to provide a desired strength and stiffness to the lid element 100 while also providing desired corrosion and/or contamination resistance with respect to food contents disposed within an interior of the container 2. In the provided example, a main layer 12 may be formed from a metallic material such as steel and alloys thereof. Other suitable metallic materials or other materials having favorable qualities can be used, as desired, such as aluminum and alloys thereof, as one additional non-limiting example. The main layer 12 may also include an additional coating (not shown) of another metallic material such as tin, as desired, to one or both sides of the base metallic material of the main layer 12, as one non-limiting alternative configuration.

The lid element 100 further includes a protective layer 13 disposed to a side of the lid element 100 facing towards an interior of the container 2 when the lid element 100 is engaging the rim 3 thereof. As used hereinafter, an axial direction of the lid element 100 corresponding to the axial direction towards the interior of the canning container 2 (when the lid element 10 is engaged thereto) is referred to as the interior axial direction, while an opposing axial direction opposite to the interior axial direction is referred to as the exterior axial direction. The protective layer 13 may be provided as a first corrosion protection layer and may be formed from a food grade protective layer, although other protective layer materials may be used as desired. The lid element 100 may, in some circumstances, include additional protective layers disposed on the exposed surface of either of the main layer 12 or the illustrated protective layer 13 without necessarily departing from the scope of the present invention.

The lid element 100 generally includes an inner face 101 facing in the interior axial direction and an opposing outer face 102 facing in the exterior axial direction when the lid element 100 is engaging the rim 3 of the container 2. In accordance with the above description of possible layered configurations of the lid element 100, the inner face 101 may be formed by whatever protective layer 13 (if multiple layers are utilized) forms the exposed surface of the lid element 100 towards the interior of the container 2, whereas the outer face 102 may be formed by the main layer 12 or a corresponding outwardly exposed protective layer (not shown) disposed outwardly on the main layer 12, depending on the number and/or types of layers utilized in forming the lid element 100.

The lid element 100 (and hence all corresponding layers 12, 13 establishing the structural configuration of the lid element 100) generally includes a peripheral portion 20 and an axially projecting portion 30. The axially projecting portion 30 forms a central portion of the lid element 100 that is axially symmetric about the central axis thereof and the peripheral portion 20 is annular in shape and disposed radially outside of the axially projecting portion 30.

The peripheral portion 20 includes an annularly extending skirt segment 24 arranged to extend at least partially in the interior axial direction of the lid element 100. The skirt segment 24 is substantially cylindrical in shape and is configured to extend around an outer circumferential surface of the rim 3 of the container 2. The skirt segment 24 also forms an outer circumferential surface of the lid element 100 having a maximum radial distance from a central axis of the lid element 100.

The peripheral portion 20 is configured to be axially aligned with the rim 3 of the container 2 about an entirety of a circumference thereof at a position radially inward of the skirt segment 24 thereof when the lid element 100 is properly engaging the rim 3. The peripheral portion 20 is primarily radially extending and may be substantially planar or substantially frustoconical in configuration between the skirt segment 24 and the axially projecting portion 30. The peripheral portion 20 includes a seal surface 22 along the inner face 101 of the lid element 100 and an oppositely arranged retainer surface 23 along the outer face 102 thereof.

An annular sealing element 40 is disposed on the inner face 101 along the seal surface 22 and includes an outwardly exposed engaging surface 42 configured to directly rest on (engage) the rim 3 of the canning container 2. The engaging surface 42 may be arranged radially or may be arranged at an inclination relative to the radial direction, as desired. The sealing element 40 may be formed from a flexible and resilient elastomeric material such as a suitable rubber. The sealing element 40 may be further configured to sealingly and compressively engage the rim 3 when a pressure differential is formed between the interior and the exterior of the canning container 2 with respect to the opposing faces 101, 102 of the lid element 100 such that the lid element 100 is urged in the interior axial direction and the sealing element 40 is compressed in the axial direction between the peripheral portion 20 and the rim 3.

The lid element 100 differs from a traditional canning lid in that the axially projecting portion 30 projects axially from the peripheral portion 20 in the interior axial direction to extend a distance axially beyond the plane defined by the rim 3 of the container 2 when the lid element 100 is resting thereon or otherwise compressively engaging the rim 3. That is, the axially projecting portion 30 extends axially into the interior of the container 2 beyond the axial position of the engaging surface 42 of the sealing element 40 (which is engaging the rim 3) for possible interaction with the contents of the container 2, as explained in greater detail hereinafter.

In general, the axially projecting portion 30 tapers inwardly to include a progressively decreasing radius (diameter) when progressing radially inwardly from the peripheral portion 20 towards the central axis of the lid element 100 and in the interior axial direction away from the peripheral portion 20. This results in the axially projecting portion 30 being maximally spaced apart from the engaging surface 42 of the sealing element 40 (corresponding to the rim 3 of the container 2 when engaged thereto) with respect to the interior axial direction along the central axis of the lid element 100.

The axially projecting portion 30, as illustrated, includes a configuration wherein the outer face 102 of the lid element 100 is initially convex in shape where the peripheral portion 20 transitions to an outward region of the axially projecting portion 30 and then transitions to a concave shape along a central region of the axially projecting portion 30 including the central axis of the lid element 100. Conversely, the inner face 101 is initially concave in shape where the peripheral portion 20 transitions to the outward region of the axially projecting portion 30 and then transitions to a convex shape along a central region of the axially projecting portion 30 including the central axis of the lid element 100. The axially projecting portion 30 may accordingly include the central portion thereof having a substantially semi-circular or semi-elliptical cross-sectional configuration where the axially projecting portion 30 is maximally spaced from the engaging surface 42 of the sealing element 40, which in turn results in the central portion having a substantially semi-spherical or otherwise rounded shape.

The axially projecting portion 30 may include an alternative configuration from that disclosed while remaining within the scope of the present invention so long as the axially projecting portion 30 extends beyond the engaging surface 42 of the sealing element 40 while also tapering inwardly with respect to the interior axial direction. Alternative shapes may include a substantially conical or frusto-conical shape of the axially projecting portion 30 when projecting axially away from the peripheral portion 20.

A distance that the axially projecting portion 30 projects axially beyond the engaging surface 42 may be selected in accordance with an expected packing configuration of the container 2 receiving the lid element 100 thereon such that a volumetric displacement of the contents of the container 2 is expected upon engagement of the lid element 100 with the rim 3. That is, the axially projecting portion 30 may be selected to extend an axial distance that would be expected to extend into the contents of the container 2 based on an expected fill level of the container relative to the position where the rim 3 interacts with the lid element 100. It has been discovered that lid elements 100 suitable for use with traditional glass containers 2 may include an axially projecting portion 30 that extends about 1 inch axially beyond the surrounding peripheral portion 20 thereof to result in a desired degree of displacement of the contents of the container 2.

Figure 4:
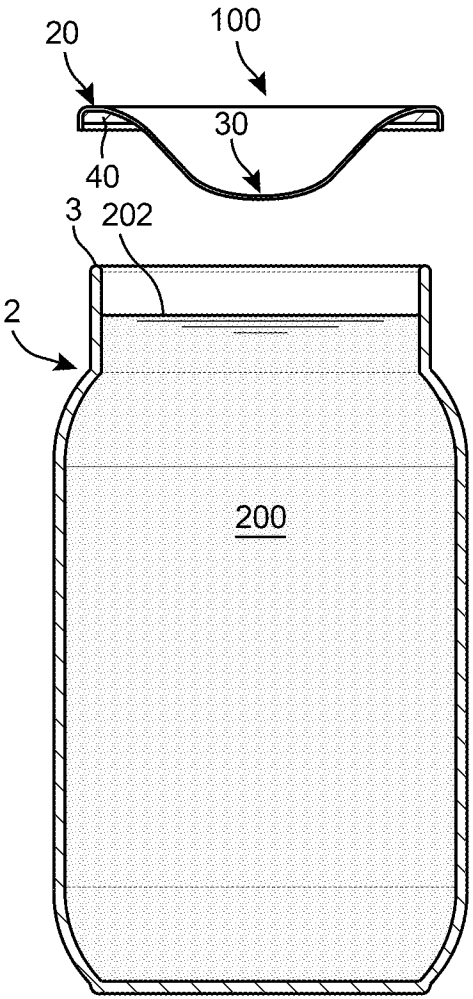
FIG. 4 is an elevational cross-sectional view showing the lid element of FIGS. 1-3 immediately prior to engagement with a canning container having a food with a liquid component disposed therein.
Figure 5:
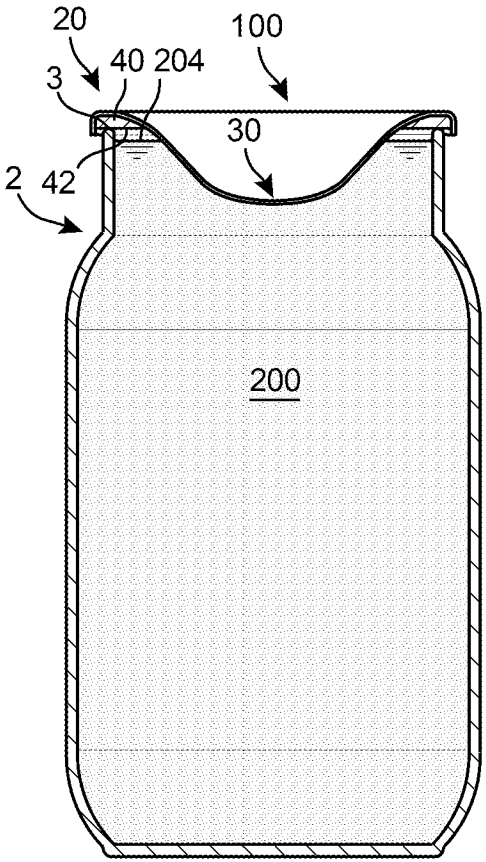
FIG. 5 is an elevational cross-sectional view showing the lid element of FIG. 4 following engagement thereof with a rim of the canning container and during a venting of gasses disposed within an interior of the canning container during a heating of the food having the liquid component.
Figure 6:
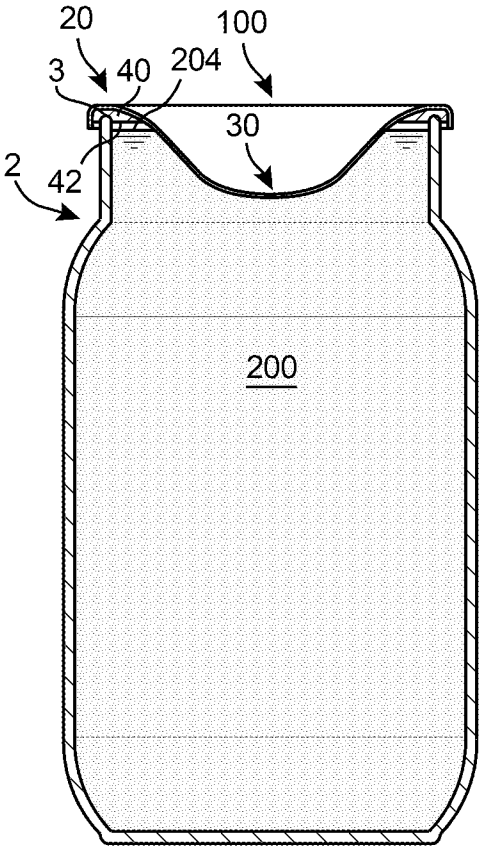
FIG. 6 is an elevational cross-sectional view showing the lid element of FIG. 5 following a cooling of the food having the liquid component disposed within the interior of the canning container to result in the formation of a vacuum-seal between the rim of the canning container and the lid element.

FIGS. 4-6 illustrate the manner in which the lid element 100 aids the storage system 10 in providing an extended shelf life for a food item 200 stored as or within a liquid within the interior of the container 2 in accordance with the inventive features of the present invention. The food item 200 is shown as being purely liquid in form in FIGS. 4-6, but it should be readily apparent that the present invention may operate as described herein when used in conjunction with food items including solids suspended within a liquid and/or a flowable semi-solid/semi-liquid type food item, so long as the resulting food item is able to flow and readjust in reaction to displacement of a portion of the food item via interaction with the lid element 100 in the manner described hereinafter.

The food item 200 is shown in FIG. 4 as initially being disposed within the container 2 to an initial fill level 202 corresponding to a level of the upper disposed surface of the liquid component of the food item prior to a canning process via the storage system 10 and prior to the lid element 100 resting on the rim 3 of the container 2, wherein the initial fill level 202 corresponds to an axial position within the interior of the container 2 that is spaced apart from the plane defined by the rim 3 thereof. The initial fill level 202 corresponds to the upper disposed surface of the food item 200 being spaced apart from the rim 3 by a first axial distance prior to introduction of the lid element 100. An upper portion of the interior of the container 2 above the initial fill level 202 is accordingly filled with air prior to engagement of the lid element 100 with the rim 3.

FIG. 5 illustrates the container 2 following the engagement of the engaging surface 42 of the sealing element 40 with the rim 3, which includes the axially projecting portion 30 of the lid element 100 extending at least partially into the food item 200 via passage of at least a portion of the axially projecting portion 30 beyond the initial fill level 202 upon movement of the lid element 100 in the interior axial direction towards the rim 3 until the engaging surface 42 rests upon the rim 3. That is, a portion of the axially projecting portion 30 projecting axially beyond the initial fill level 202 displaces a volume of the food item 200 in comparison to the depiction thereof in FIG. 4, which results in a readjustment of the level of the food item 200 to subsequently be disposed at an adjusted fill level 204 such as is depicted in FIG. 5.

The adjusted fill level 204 corresponds to the upper disposed surface of the food item 200 being spaced apart from the rim 3 (and the engaging surface 42) by a second axial distance that is less than the previously described first axial distance. This readjustment results in a lower volume of gaseous materials (air and any evaporated food item) being disposed within the interior of the container between the inner face 101 of the lid element 100 and the upper disposed surface of the food item 200 in comparison to the volume of gaseous materials (air) disposed in the space between the rim 3 and the upper surface of the food item 200 when at the initial fill level 202. Similarly, the upper disposed surface of the food item is reduced from a circular area to an annular or ring-shaped area adjacent the peripheral portion 20 of the lid element 100 as a result of the tapered shape of the axially projecting portion 30, which results in a reduced surface area of the food item 200 being directly exposed to the gaseous materials disposed between the adjusted fill level 204 and the inner face 101 of the lid element 100.

The storage system 10 is prepared for undergoing a canning process when in the configuration of FIG. 5. Although not shown, the retainer element 6 may be threaded relative a corresponding thread of the container 2 adjacent the rim 3 thereof to result in the radially extending flanged portion 7 of the retainer element 6 approaching the retainer surface 23 of the peripheral portion 20. The retainer element 6 may be adjusted to a position wherein the lid element 100 is retained between the flanged portion 7 and the rim 3 while still allowing for limited movement of the lid element 100 away from the rim 3 for venting gases from within the interior of the container 2. That is, during a heating of the container 2 and the food item 200 disposed therein, an expansion of the food item 200 and any gaseous materials contained within the interior of the container 2 results in an increase in pressure within the interior of the container 2 until the lid element 100 is displaced from engaging the rim 3 and high pressure gases are vented out of the interior of the container 2 through a gap temporarily formed between the engaging surface 42 and the rim 3.

Once the container 2 and food item 200 have been suitably heated during the canning process, it is understood that an eventual cooling and contraction of the contents of the container 2 results in a reduced pressure being present within the interior of the container 2. The resulting pressure differential then present between the ambient environment and the interior of the container 2 causes a pressure force to be applied to the lid element 100 in the interior axial direction, which in turn compresses the sealing element 40 against the rim 3 for forming an air and fluid tight seal around a perimeter thereof. Such a condition is shown in FIG. 6, wherein the lid element 100 has progressed slightly in the interior axial direction in accordance with the illustrated compression of the sealing element 40. It is also worth noting that FIG. 6 depicts the adjusted fill level 204 as being elevated towards the rim 3 in comparison to FIG. 5 as a result of continued progression of the axially projecting portion 30 into the food item 200, thereby displacing an additional volume thereof. However, it should be understood that this may not always be the outcome based on a variety of factors, such as the volume of gases vented from the interior of the container 2 during the canning process and/or the form and consistency of the food item 200, hence such an outcome is not considered limiting to the present invention. In any circumstance, the lid element 100 is provided to extend a distance into the food item 200 such that the adjusted fill level 204 is still maintained at the second axial distance that is less than the described first axial distance as a result of the displacement of at least some of the food item 200 by the central portion of the axially extending portion 30, regardless of the effects of the canning process and the formation of the vacuum seal within the container 2 in the manner described.

The storage system 10 provides for an extended shelf life for such food items stored as or within a liquid because the displacement of air via the axially projecting portion 30 reduces the presence of oxygen and other air molecules within the interior of the container 2. Generally, bacteria needs oxygen to break up organic matter, and without the presence of air molecules, the bacteria are not able to begin the decomposition process. The reduction in the quantity of such molecules therefore directly results is less opportunity for a decomposition process to take place with respect to the food item 200. Additionally, the reduction in exposed surface area of the food item 200 along the annular surface corresponding to the adjusted fill level 204 results in a reduced surface area of the food item 200 being exposed for contamination to such molecules, which slows the rate of any corresponding process occurring as a result of exposure of the food item 200 to the gases contained above the adjusted fill level 204.

It should be readily apparent that the described method of reducing contamination relies upon the initial fill level 202 being disposed at an axial position such that the axially projecting portion 30 projects a suitable distance therein for displacing a desired volume of the food item 200. The disclosed axial positions of the initial fill level 202 and the adjusted fill level 204 should accordingly not be considered to be limiting, as the same principles of operation will apply regardless of the degree of reduction of volume of the gaseous materials adjacent the rim 3. In some circumstances, the axially projecting portion 30 may be configured to extend into the food item 200 until there is no air remaining within the interior of the container 2. In order to ensure a desired degree of displacement, the lid element 100 as shown and described may be utilized in conjunction with a container 2 having fill level markings (not shown) identifying a desirable position of the initial fill level 202 for ensuring a correspondingly desirable adjusted fill level 204 based on the configuration of a specific lid element 100. Alternatively, a variety of lid elements 100 having different axial depths of the axially projecting portion 30 may be provided with respect to a single initial fill level 202 to arrive at a desirable adjusted fill level 204.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A lid element for use with a canning container having a rim leading into an interior thereof, a food item disposed within the interior of the canning container as a liquid or within a liquid, and a volume of air disposed within the interior of the canning container, the lid element comprising:

a centrally disposed axially projecting portion, an annular peripheral portion disposed radially outwardly of the axially projecting portion; and an annular sealing element disposed on the peripheral portion and configured to engage the rim of the container, wherein, when the sealing element engages the rim of the container, the axially projecting portion projects axially from the peripheral portion beyond the rim of the container with respect to an interior axial direction of the lid element and at least a central region of the axially projecting portion is disposed within and contacting the food item within the interior of the canning container to displace a portion of the food item and adjust an upper surface of the food item from an initial fill level to an adjusted fill level, the initial fill level spaced apart from the rim of the canning container by a first axial distance prior to at least the central region of the axially projecting portion contacting the food item and the adjusted fill level spaced apart from the rim of the canning container by a second axial distance that is less than the first axial distance following submersion of at least the central region of the axially projecting portion within the food item, wherein, when the sealing element engages the rim of the canning container, an annular space is formed in a radial direction of the canning container between an inner face of the lid element along the axially projecting portion and an inner circumferential surface of the canning container extending downwardly from the rim thereof and wherein the annular space includes a lower portion occupied by a portion of the food item and an upper portion occupied by the volume of air remaining within the interior of the canning container between the upper surface of the food item and a portion of the inner face of the lid element not submerged within the food item.

2. The lid element of claim 1, wherein the axially projecting portion tapers radially inwardly when progressing in the interior axial direction away from the peripheral portion.

3. The lid element of claim 2, wherein, when the sealing element engages the rim, the axially projecting portion is spaced a maximum axial distance from the rim along a central axis of the lid element.

4. The lid element of claim 1, wherein, when the sealing element engages the rim, the inner face of the lid element faces in the interior axial direction, and wherein the inner face transitions from a concave surface to a convex surface as the axially projecting portion projects away from the peripheral portion in the interior axial direction.

5. The lid element of claim 4, wherein the convex surface is formed along a central axis of the lid element.

6. The lid element of claim 4, wherein the convex surface is arcuate in shape.

7. The lid element of claim 1, wherein the axially projecting portion is axially symmetric about a central axis of the lid element.

8. The lid element of claim 1, wherein the sealing element is formed from an elastomeric material.

9. The lid element of claim 1, wherein the lid element is formed from a main layer and at least one protective layer disposed on the main layer.

10. The lid element of claim 9, wherein the at least one protective layer forms the inner face of the lid element facing in the interior axial direction towards the interior of the canning container.

11. The lid element of claim 9, wherein the at least one protective layer is a food grade protective layer.

12. The lid element of claim 9, wherein the main layer is formed from a metallic material.

13. The lid element of claim 1, wherein an adjustment of the upper surface of the food item from the initial fill level to the adjusted fill level results in a progressive reduction of the volume of a gas contained within the interior of the canning container between the upper surface of the food item and an inner face of the lid element to reduce an incidence of contamination of the food item by the volume of gas remaining within the canning container when the sealing element engages the rim of the canning container.

14. The lid element of claim 1, wherein an adjustment of the upper surface of the food item from the initial fill level to the adjusted fill level results in a progressive reduction of a surface area of the upper surface of the food item exposed to the volume of a gas contained within the interior of the canning container between the upper surface of the food item and an inner face of the lid element to reduce an incidence of contamination of the food item by the volume of gas remaining within the canning container when the sealing element engages the rim of the canning container.

15. The lid element of claim 1, wherein the food item remains at the adjusted fill level with at least the central region of the axially projecting portion disposed within and contacting the food item following formation of a pressure differential across the lid element that compressively seals the sealing element against the rim of the canning container.

16. A canning container assembly comprising:

a canning container having a rim adjacent a threaded portion thereof, wherein an interior of the canning container includes a food item stored as a liquid or within a liquid;

a lid element comprising:

a centrally disposed axially projecting portion, an annular peripheral portion disposed radially outwardly of the axially projecting portion; and an annular sealing element disposed on the peripheral portion and engaging the rim of the canning container, wherein the axially projecting portion projects axially from the peripheral portion beyond the rim of the canning container with respect to an interior axial direction of the lid element to cause at least a central region of the axially projecting portion to be disposed within and contacting the food item within the interior of the canning container to displace a portion of the food item and adjust an upper surface of the food item from an initial fill level to an adjusted fill level, the initial fill level spaced apart from the rim of the canning container by a first axial distance prior to at least the central region of the axially projecting portion contacting the food item and the adjusted fill level spaced apart from the rim of the canning container by a second axial distance that is less than the first axial distance following submersion of at least the central region of the axially projecting portion within the food item, wherein, when the sealing element engages the rim of the canning container, an annular space is formed in a radial direction of the canning container between an inner face of the lid element along the axially projecting portion and an inner circumferential surface of the canning container extending downwardly from the rim thereof and wherein the annular space includes a lower portion occupied by a portion of the food item and an upper portion occupied by the volume of air remaining within the interior of the canning container between the upper surface of the food item and a portion of the inner face of the lid element not submerged within the food item; and a retainer element configured to threadably engage the threaded portion of the canning container with the peripheral portion of the lid element disposed between the retainer element and the rim of the canning container.

* * * * *